US005906144A

United States Patent [19]

Staviski et al.

[11] Patent Number: 5,906,144

[45] Date of Patent: May 25, 1999

[54] TOE-NAILING HAMMER

[76] Inventors: Nick W. Staviski, 102 Thayer Rd.; Francis W. Staviski, 102 Winecoop Creek Rd., both of Erin, N.Y. 14838

[21] Appl. No.: 09/086,480

[22] Filed: May 28, 1998

[51] Int. Cl.[6] ..... B25D 1/00

[52] U.S. Cl. ..... 81/20; 81/177.1; D8/75

[58] Field of Search ..... 81/20, 177.1, 489, 81/75, 77, 78, 79; D8/80; 254/26

[56] References Cited

U.S. PATENT DOCUMENTS

| | | | |
|---|---|---|---|
| D. 27,949 | 12/1897 | Sommer | 81/20 |
| D. 28,662 | 5/1898 | Young | 81/20 |
| D. 50,556 | 4/1917 | Hildebrandt | D8/78 |
| D. 141,566 | 6/1945 | Johnson . | |
| D. 209,653 | 12/1967 | Vogel . | |
| D. 211,963 | 8/1968 | Fortenberry . | |
| D. 291,402 | 8/1987 | Square | D8/75 |
| 755,355 | 3/1904 | Carlsen | 81/20 |
| 1,326,022 | 12/1919 | Callaway | 81/177.1 |
| 3,999,275 | 12/1976 | Schmidt | D8/75 |
| 4,038,719 | 8/1977 | Bennett . | |
| 4,363,344 | 12/1982 | Pollak . | |
| 4,958,540 | 9/1990 | Davis . | |
| 5,280,738 | 1/1994 | Liou . | |

FOREIGN PATENT DOCUMENTS

| | | | |
|---|---|---|---|
| 21725 | 12/1916 | Denmark . | |
| 538614 | 11/1931 | Germany | 81/20 |
| 646775 | 11/1950 | United Kingdom | 81/20 |
| 2048752 | 12/1980 | United Kingdom . | |

*Primary Examiner*—David A. Scherbel
*Assistant Examiner*—Joni B. Danganan
*Attorney, Agent, or Firm*—Brown, Pinnisi & Michaels, P.C.

[57] ABSTRACT

A toenail hammer includes a head connected to a handle by a shank, where the shank is substantially bent such that, when toenailing in a confined space or around an obstacle the bent shape allows the nail being driven to be struck by the normal striking face of the hammer instead of the side face. The head and handle are in substantially the same relative alignment as in an ordinary hammer. An alternative embodiment positions the claw on the bent shank instead of the head.

10 Claims, 5 Drawing Sheets

TOE-NAILING HAMMER

FIELD OF THE INVENTION

The invention pertains to the field of hammers. More specifically, the invention pertains to the development of a hammer particularly suited for use in confined spaces or at otherwise difficult angles.

BACKGROUND OF THE INVENTION

The hammer was perhaps Mankind's first tool. Designed simply for pounding, the original hammer was a stone held in the hand. Vase paintings demonstrate that the ancient Greek bronzesmiths were using stone "hammers" in this way as late as the fourth century B.C. With the Romans came the use of the recognizable claw hammer useful for carpenters in their efforts to build and secure wooden structures.

Contemporary hammers useful in carpentry are generally composed of a straight handle disposed at right angles to a hammerhead. Of these, the claw hammer remains ubiquitous, being designed so that the hammerhead itself, most often composed of iron, or a hard metal alloy, has a relatively flat striking area designed to make contact with a nail or other fastener. The end opposite this striking area is designed to remove nails through the use of a curved split peen or "claw."

While using the hammer, the holder employs the full movement of the arm and wrist to strike a nail with the hammerhead striking area with sufficient force to drive the nail into a given media, typically wood. When the hammerhead makes contact with the nail, the handle portion is generally parallel to the planar working surface.

On a modern construction site, carpenters and others have many opportunities to employ the claw hammer, or other similar hammers, to complete many tasks. In addition, many of the operations for which hammers are used can now be completed through the use of a variety of pneumatic tools. These tools include nail guns that make securing or building wooden structures considerably easier and faster than previously possible.

However, though many operations in rough framing or carpentry generally are completed with a standard claw hammer, the construction of a home typically entails the creation of working surfaces that are in confined spaces or otherwise difficult to get to. In particular, toenailing joists is not easy. In these difficult operations, standard hammers are clumsy and inefficient. Similarly, pneumatic tools often cannot be employed at odd angles or in confined spaces. The expense of these pneumatic tools also makes them less than efficient on the job site when confronted with the need to secure floor joists, box ribbons, ceiling joists, rafters or other jobs in which nails must be put in at difficult angles.

Accordingly, a need exists for a hammer that can be easily employed to reach the confined spaces that typically are difficult to reach.

SUMMARY OF THE INVENTION

Briefly stated, a toenail hammer includes a head connected to a handle by a shank, where the shank is substantially bent such that, when toenailing in a confined space or around an obstacle the bent shape allows the nail being driven to be struck by the normal striking face of the hammer instead of the side face. The head and handle are in substantially the same relative alignment as in an ordinary hammer. In an alternative embodiment the claw may be absent or positioned on the bent shank instead of the head.

According to an embodiment of the invention, a hammer includes a head, a handle, and a shank interconnecting the hammerhead and the handle. The shank itself includes a first region integrally connected to the head, a third region integrally connected to the handle, and a second region connecting the first and third regions. The shank is bent such that when in use the hammer can avoid obstructions located between the handle and the head.

According to another embodiment of the invention, a hammer includes a head having a claw formed in the shape of a curved split peen, and a bell. In this embodiment the shank connecting the head to the handle has a diamond shaped cross section to provide strength. The shank consists of a first shank region connected to the head, a third shank region connected to the handle, and a second shank region connecting the first and third shank regions to each other. The shank is bent such that the second shank region and angular axes of each of the first, second, and third shank regions substantially describe a trapezoid.

According to another embodiment of the invention, a hammer includes a head, a handle, and a shank means for connecting the head and the handle together. The shank means is itself bent such that when used the hammer can avoid an obstruction located between the handle and the head.

Other features and advantages of this invention will become apparent in the following detailed description of a preferred embodiment of this invention with reference to the accompanying drawings.

DESCRIPTION OF THE PREFERRED EMBODIMENT

Figure 1:
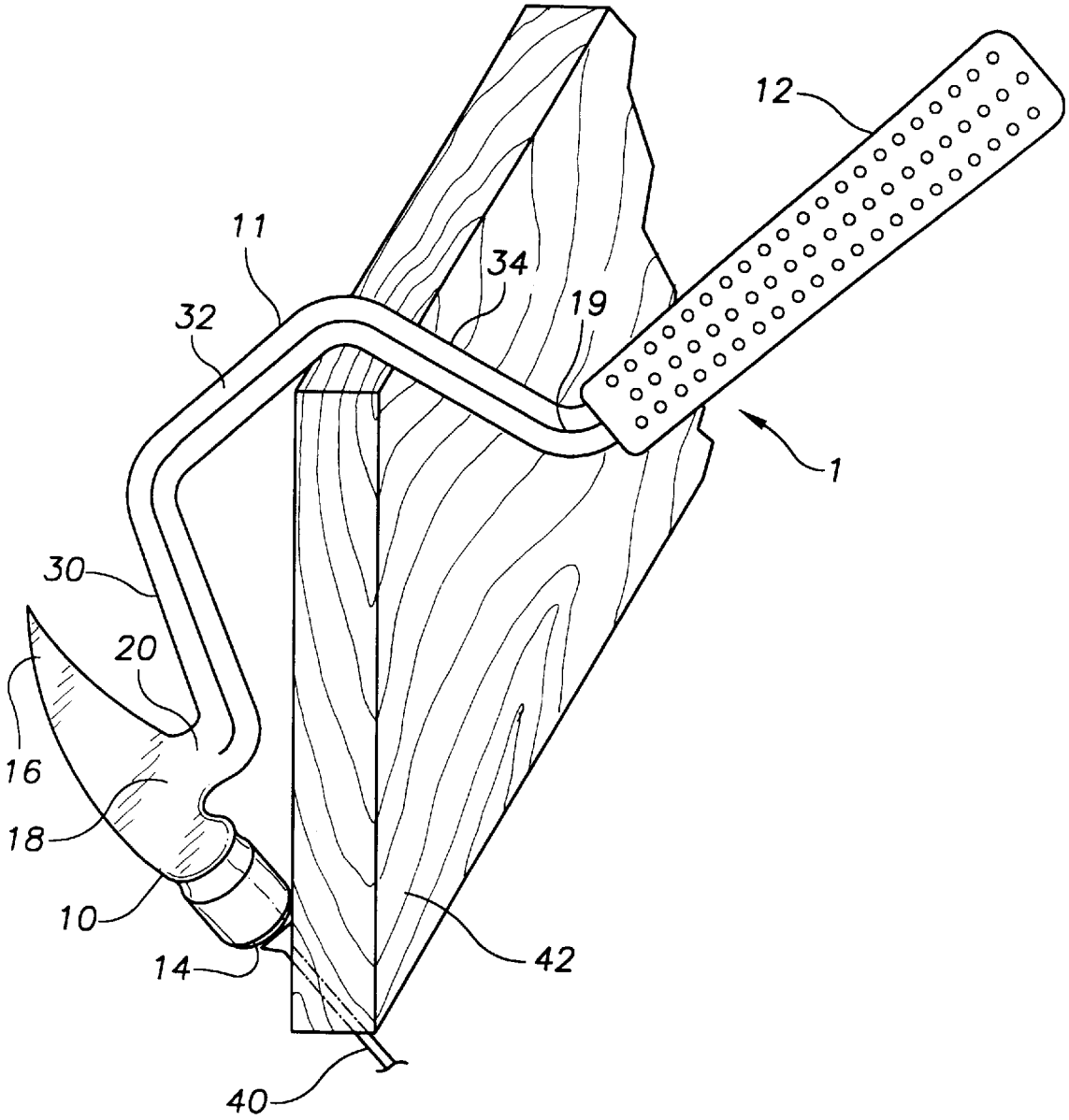
FIG. 1 shows a side view of a hammer according to a first embodiment of the present invention.

Referring to FIG. 1, a first embodiment of a hammer 1 includes a head 10 connected to a handle 12 by a shank 11. Head 10 of hammer 1 includes a planar striking face conventionally known as a bell 14. A claw 16 is preferably located at an end opposite head 10 from bell 14. Claw 16 may be shaped in any one of a number of ways that are conventionally known, but is typically configured as a curved split peen. Claw 16 and bell 14 are connected by an intermediate portion 18 of head 10. When nailing, bell 14 strikes a nail 40, driving it into an object being nailed such as a board 42.

Shank 11 includes a connecting portion 20 connecting one end of shank 11 to head 10, as well as a connecting portion 19 connecting another end of shank 11 to handle 12. Shank 11 is divided into first, second, and third shank regions 30, 32, and 34. Second shank region 32 is preferably substantially parallel to handle 12.

Shank 11 is substantially bent such that, when toenailing in a confined space or around an obstacle, the bent shape allows nail 40 to be struck by bell 14 of a side of head 10. Head 10 and handle 12 are preferably in substantially the same relative alignment as in an ordinary hammer. The precise placement of connecting portion 20 with respect to intermediate portion 18 of head 10 depends on the weight and balance desired for hammer 1. Connecting portion 20 preferably meets intermediate portion 18 at a right angle since this configuration provides the maximum offset between first shank region 30 and claw 16.

First shank region 30 extends away from connecting portion 20 at an angle between approximately 60° and 90°. Second shank region 32 and extends away from first shank region 30 at an angle between approximately 90° and 120° so that second shank region 32 is approximately parallel to handle 12. Third shank region 34 preferably extends away from second shank region 32 at an angle between approximately 90° and 120°.

The length of first, second, and third shank regions 30, 32, and 34 are such that when hammer 1 is employed, obstructions that prevent the use of a conventional hammer are avoided. In addition, the lengths of first and third shank regions 30, 34 are preferably such that intermediate portion 18 of head 10 is on an extended axis of handle 12. The lengths of connecting portion 20 and handle 12 may be varied according to the application for which hammer 1 is to be used. In this embodiment, the axes of first, second, and third shank regions 30, 32, 34 and the extended axis of handle 12 substantially describe a trapezoid. Phrased differently, extended axes of first and third shank regions 30, 34 form a triangle with second shank region 32. This configuration has been found to best avoid obstructions and speed the completion of difficult framing projects such as floor joists, or rafters without deviating excessively in overall size and shape from a conventional hammer.

Figure 2:
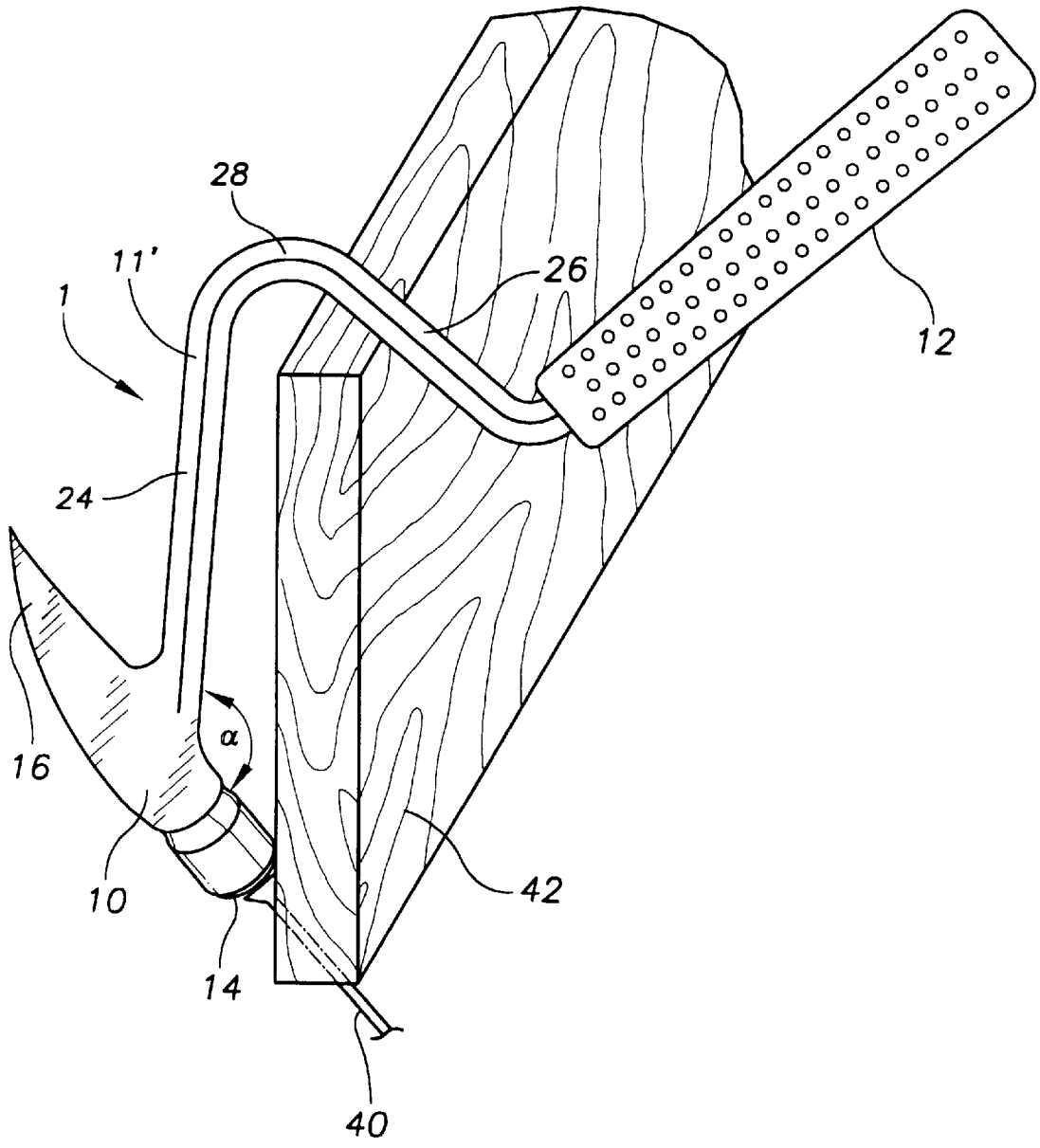
FIG. 2 shows a side view of a hammer according to a second embodiment of the present invention.

Referring to FIG. 2, a second embodiment of hammer 1 includes a shank 11' with one end connected to a head 10 and another end connected to a handle 12. When nailing, a bell 14 of head 10 strikes a nail 40, driving it into an object being nailed such as a board 42. Instead of being divided into three distinct straight regions as in the first embodiment, shank 11' includes a first region 24 and a third region 26 connected by a curved region 28. The length of first and third regions 24, 26 and curved region 28 are such that when hammer 1 is employed, obstructions that prevent the use of a conventional hammer are avoided. Curved region 28 can optionally be shaped as any type of curve, whether circular, sinusoidal, etc. In addition, the lengths of first and third shank regions 24, 26 are preferably such that head 10 is on an extended axis of handle 12. Note that no connecting portion joins first region 24 to head 10 since an angle $\alpha$ that first region 24 makes to the long axis of head 10 provides for sufficient offset of a claw 16. Angle $\alpha$ is preferably such that first region 24 is approximately parallel to a height of board 42 when bell 14 impacts nail 40.

Figure 3A:
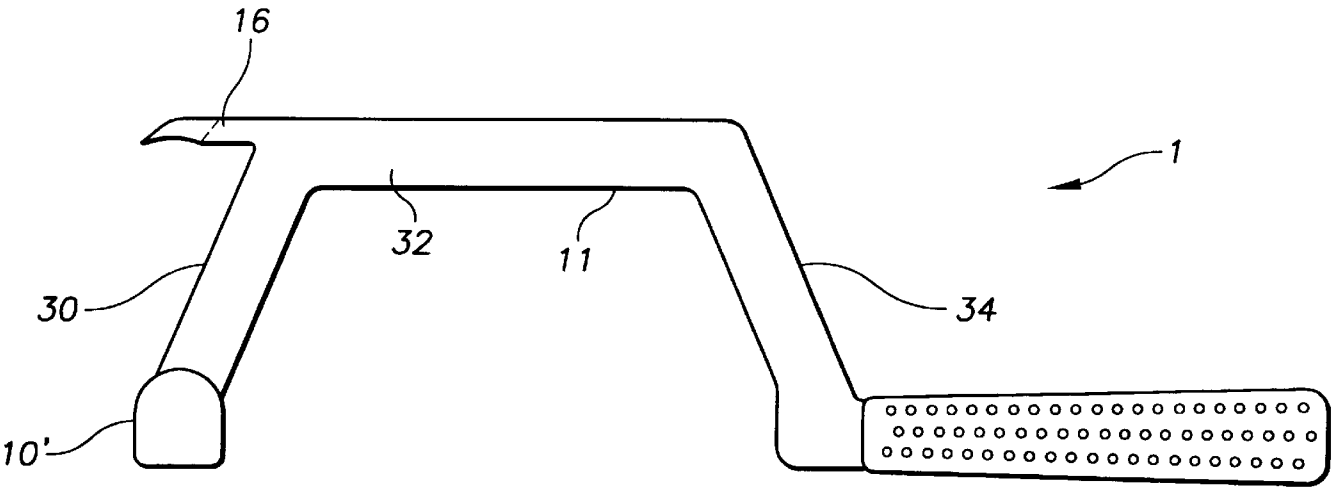
FIG. 3A shows a side view of a hammer according to a third embodiment of the present invention.

Referring to FIG. 3A, a third embodiment of the invention includes a shank 11 connected between a handle 12 and a head 10'. A claw 16 is connected to shank 11 at a juncture of a first region 30 and a second region 32. Region 30 of shank 11 can connect directly to head 10' since no offset for claw 16 is necessary.

Figure 3B:
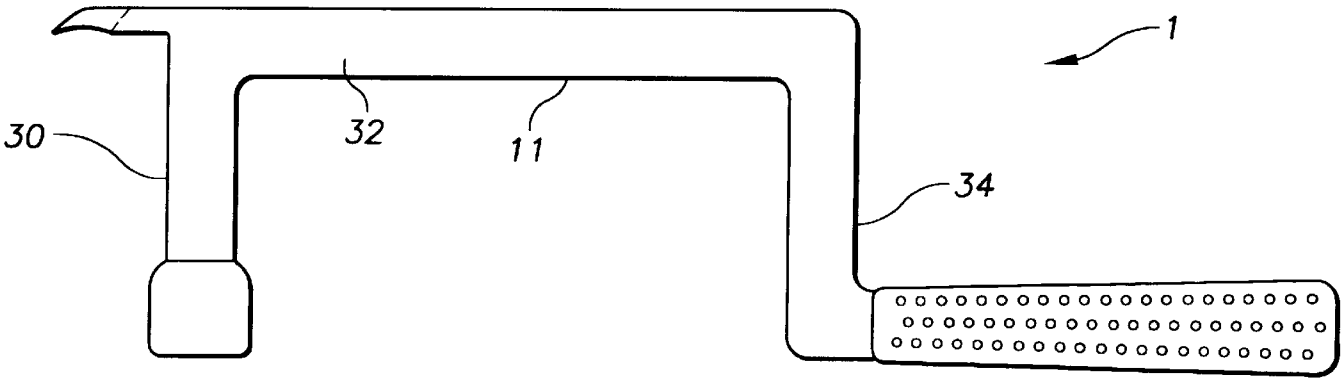
FIG. 3B shows a side view of a hammer according to a variation of the third embodiment of the present invention.

Referring to FIG. 3B, in a variation of the third embodiment, regions 30, 32, and 34 of shank 11 are at substantially right angles to each other. Regions 30, 32, and 34 describe three sides of a rectangle.

Figure 4:
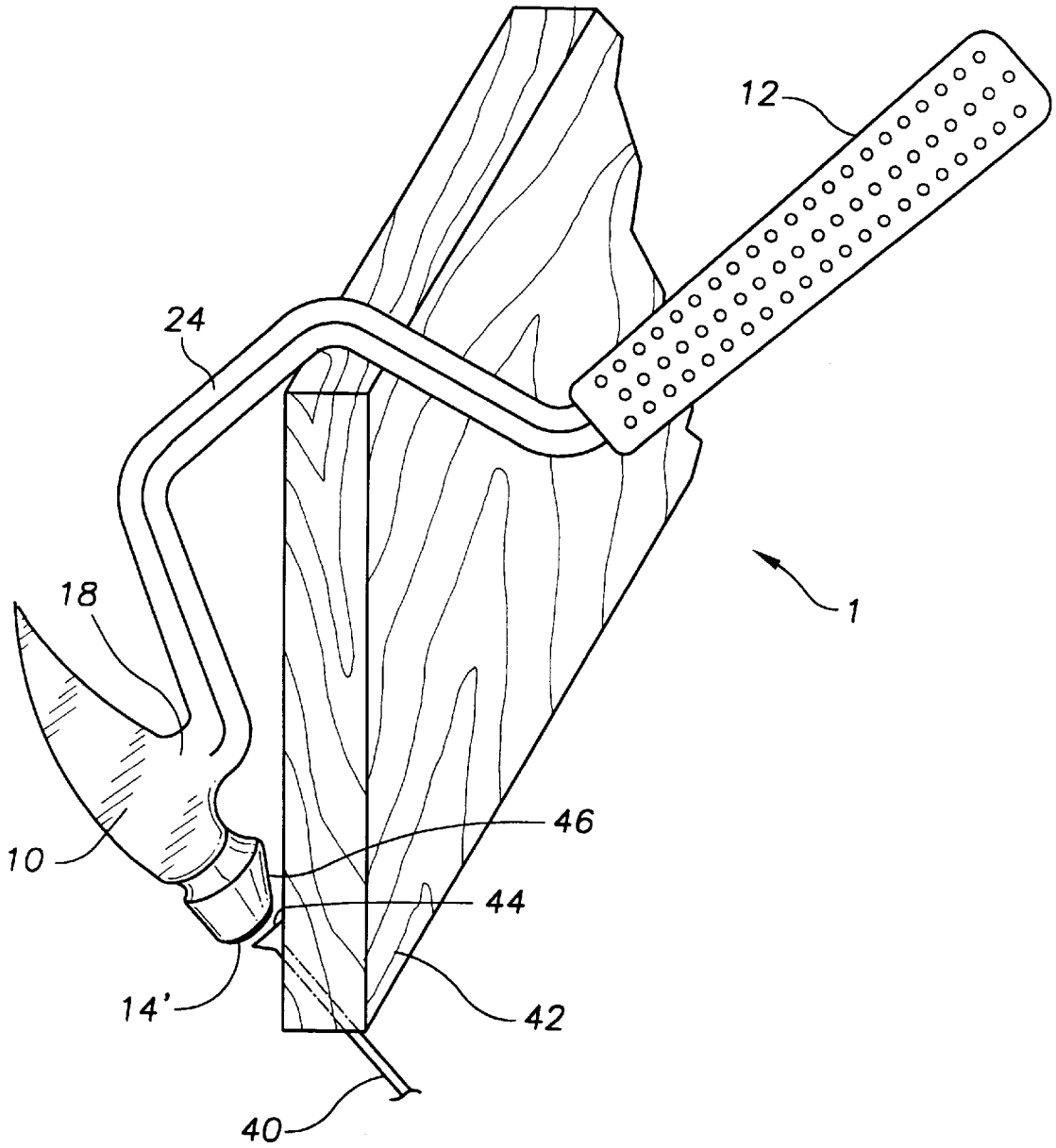
FIG. 4 shows a side view of a hammer according to an embodiment of the present invention that has a reduced surface bell.
Figure 5A:
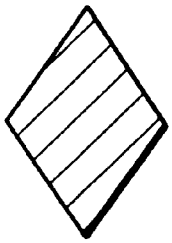
FIG. 5A shows a cross-sectional shape for the shank of the hammer of an embodiment of the present invention.
Figure 5B:
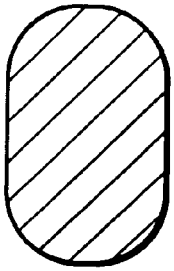
FIG. 5B shows a cross-sectional shape for the shank of the hammer of an embodiment of the present invention.
Figure 5C:
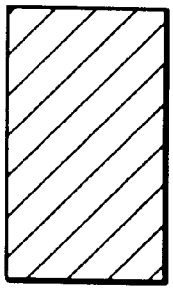
FIG. 5C shows a cross-sectional shape for the shank of the hammer of an embodiment of the present invention.
Figure 5D:
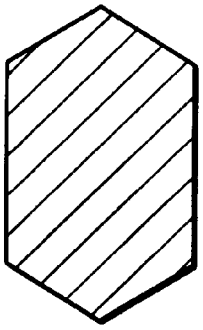
FIG. 5D shows a cross-sectional shape for the shank of the hammer of an embodiment of the present invention.
Figure 5E:
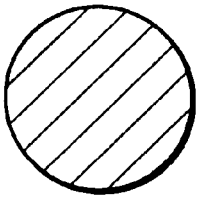
FIG. 5E shows a cross-sectional shape for the shank of the hammer of an embodiment of the present invention.
Figure 5F:
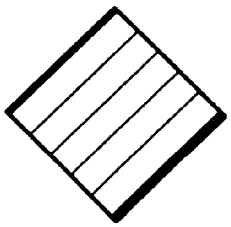
FIG. 5F shows a cross-sectional shape for the shank of the hammer of an embodiment of the present invention.

Referring to FIG. 4, a bell 14' of a head 10 is altered so as to increase the efficiency of driving a nail 40 into a board 42. Bell 14' is reduced in size by altering the shape of head 10. A beveled portion 46 of head 10 reduces that part of head 10 most likely to come into contact with board 42 while driving nail 40.

Referring to FIGS. 5A–F, various cross-sectional shapes for shank 11 are shown. The preferred embodiment for the hammer of the present invention has a "diamond" shaped cross-section so as to impart maximal strength and durability to shank 11 while minimizing weight. However, it should be understood that a variety of other cross-sectional shapes, including ellipsoid, square, or rectangular, round, or hexagonal, might be employed in shank 11. In addition, shank 11 or handle 12 may be of tubular construction if the materials used in fabrication are sufficiently strong so as to impart structural stability to hammer 1 while in use.

Head 10 may be fabricated from a metal or other structurally adequate material. Shank 11 and handle 12 may be made from wood, glass fiber, plastic, metal, Kevlar™, or other suitable materials. The weight of the hammer, length of individual shank regions 30, 32, and 34, the cross-sectional shape of shank 11, and the type of hammerhead can be varied depending upon the application for which the hammer is needed. Handle 12 may be covered by a grip surface composed of vinyl, plastic, rubber, or other material capable of enhancing ease of use and non-slip characteristics.

Head 10 and shank 11 may be one-piece or integral. Although handle 12 is usually integral to head 10 and shank 11, it may be part of a one-piece hammer 1. If head 10 and shank 11 are manufactured separately and later joined via connecting portion 20, connecting portion 20 must be rigidly and securely attached to head 10. Typically, a through hole (not shown) is formed in intermediate portion 18 for receiving a section of connecting portion 20. The method of securing shank 11 to head 10 can be done in any number of ways known in the prior art.

From the above it can be appreciated that the hammer of the present invention provides increased mechanical advantage for use on difficult nailing projects and has a comfortable feel and grasp.

Accordingly, it is to be understood that the embodiments of the invention herein described are merely illustrative of the application of the principles of the invention. It will be evident from the foregoing description that changes in the form, proportion and construction of the parts of the hammer disclosed may be resorted to without departing from the spirit of the invention, or the scope of the appended claims.

What is claimed is:

1. A hammer, comprising:

a head a handle;

a shank connected between said head and said handle, wherein said shank includes a) a first shank portion connected to said head;

b) a third shank portion connected to said handle;

c) a second shank portion connected between said first and third shank portions; and wherein said shank is shaped such that said hammer avoids an obstruction located between said handle and said head during nailing, and wherein said first and third shank portions are substantially straight, said third shank portion is angled with respect to said handle, said first shank portion is angled with respect to said head, and said second shank portion is angled with respect to said first and third shank portions.

2. A hammer according to claim 1 wherein said second shank portion is curved.

3. A hammer according to claim 1 wherein the cross-sectional shape of said shank is taken from the group of shapes consisting of: round, square, ellipsoid, rectangular, hexagonal, and diamond.

4. A hammer according to claim 1, wherein said hammer is manufactured as a one-piece body.

5. A hammer according to claim 1, wherein said handle is tubular in construction.

6. A hammer according to claim 1 wherein a bell of said head is beveled so as to reduce the size of that portion of said head most likely to be obstructed during nailing.

7. A hammer, comprising:

a head;

a handle;

a shank connected between said head and said handle, wherein said shank includes a) a first shank portion connected to said head;

b) a third shank portion connected to said handle:

c) a second shank portion connected between said first an third shank portions;

wherein said shank is shaped such that said hammer avoids an obstruction located between said handle and said head during nailing, and wherein said second shaft portion, said first shank portion, and said third shank portion substantially describe three sides of a trapezoid.

8. A hammer, comprising:

a head;

a handle;

a shank connected between said head and said handle wherein said shank includes a) a first shank portion connected to said head;

b) a third shank portion connected to said handle;

c) a second shank portion connected between said first and third shank portions;

wherein said shank is shaped such that said hammer avoids an obstruction located between said handle and said head during nailing, and wherein said first, second, and third shank portions substantially describe three sides of a rectangle.

9. A hammer, comprising:

a head;

a handle;

a shank connected between said head and said handle, wherein said shank includes a) a first shank portion connected to said head;

b) a third shank portion connected to said handle;

c) a second shank portion connected between said first and third shank portions;

wherein said shank is shaped such that said hammer avoids an obstruction located between said handle and said head during nailing, and wherein a split peen is integrally connected to said first and second shank portions at the portion of said shank where said first and second shank portions join.

10. A hammer, comprising:

a head;

a handle; and connecting means for connecting said head and said handle together wherein said connecting means is shaped such that said hammer avoids an obstruction located between said handle and said head during nailing, wherein said connecting means includes a first straight portion angled with respect to said head, a third straight portion connected to said handle and angled with respect to said handle, and a second portion connecting said first straight portion and said third straight portion directly to each other, wherein said second portion is angled with respect to said first straight portion and said third straight portion.

* * * * *